US008770166B2

(12) United States Patent
Tucker

(10) Patent No.: US 8,770,166 B2
(45) Date of Patent: Jul. 8, 2014

(54) MULTI-MODE AIR INDUCTION TUNING DUCT

(75) Inventor: Eric R. Tucker, Waterford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 260 days.

(21) Appl. No.: 13/440,263

(22) Filed: Apr. 5, 2012

(65) Prior Publication Data

US 2013/0263810 A1 Oct. 10, 2013

(51) Int. Cl.
*F02M 35/10* (2006.01)

(52) U.S. Cl.
USPC ..... 123/184.56; 123/184.57

(58) Field of Classification Search
USPC ..... 123/184.53, 184.56, 184.57; 181/229
See application file for complete search history.

(56) References Cited

U.S. PATENT DOCUMENTS 5,613,478 A * 3/1997 Widmann ..... 123/564
5,937,815 A * 8/1999 Hidaka ..... 123/184.56
6,805,087 B2 * 10/2004 Yakabe et al. ..... 123/184.51

* cited by examiner

*Primary Examiner* — Noah Kamen
(74) *Attorney, Agent, or Firm* — Ingrassia Fisher & Lorenz, P.C.

(57) ABSTRACT

Methods and apparatuses are provided for an air inlet duct of an internal combustion engine. The air inlet duct includes a tubular housing. An inner wall has a plurality of perforations. The inner wall is disposed within the tubular housing such that the tubular housing includes at least two flow passages. A valve set is associated with a first flow passage of the at least two flow passages. The valve set selectively controls airflow through the first flow passage such that the first flow passage functions in a least one of a pass-through mode and a tuning mode.

19 Claims, 5 Drawing Sheets

MULTI-MODE AIR INDUCTION TUNING DUCT

TECHNICAL FIELD

The present disclosure relates to air induction systems for internal combustion engines, and more particularly to an inlet duct of an air induction system for an internal combustion engine.

BACKGROUND

Internal combustion engines combust an air and fuel mixture to produce drive torque. Air is supplied to the engine through an air induction system. As a consequence of the combustion within the engine, noise is generated. The air induction system likewise generates noise. Such noises may be undesirable to a vehicle occupant.

Air intake noise varies in amplitude across a wide frequency spectrum depending upon the operational characteristics of the particular internal combustion engine. In some cases, air induction noise can be reduced by employing a small diameter air inlet port within the air induction system. While this arrangement works well at low engine speeds (i.e., low revolutions per minute (RPM)), the engine may not be supplied with sufficient air at high engine speeds (i.e., high RPM). Conversely, a large diameter air inlet will provide sufficient air at both high and low engine speeds; however, such an arrangement leads to increased air intake noise.

Accordingly, it is desirable to provide an air induction system that that can accommodate engine load demands while still minimizing the undesirable noise generated. It is further desirable to provide such an air induction system in a way that minimizes the overall packaging. Furthermore, other desirable features and characteristics will become apparent from the subsequent detailed description and the appended claims, taken in conjunction with the accompanying drawings and the foregoing technical field and background.

SUMMARY

An apparatus is provided for an air inlet duct of an internal combustion engine. The apparatus comprises an air inlet duct. The air inlet duct includes a tubular housing. An inner wall has a plurality of perforations. The inner wall is disposed within the tubular housing such that the tubular housing includes at least two flow passages. A valve set is associated with a first flow passage of the at least two flow passages. The valve set selectively controls airflow through the first flow passage such that the first flow passage functions in at least one of a pass-through mode and a tuning mode.

The above features and advantages and other features and advantages are readily apparent from the following detailed description when taken in connection with the accompanying drawings.

DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the disclosure or the application and uses of the disclosure. Furthermore, there is no intention to be bound by any expressed or implied theory presented in the preceding technical field, background, brief summary or the following detailed description.

The following description refers to elements or features being "connected" or "coupled" together. As used herein, "connected" may refer to one element/feature being directly joined to (or directly communicating with) another element/feature, and not necessarily mechanically. Likewise, "coupled" may refer to one element/feature being directly or indirectly joined to (or directly or indirectly communicating with) another element/feature, and not necessarily mechanically. However, it should be understood that, although two elements may be described below, in one embodiment, as being "connected," in alternative embodiments similar elements may be "coupled," and vice versa. Thus, although the figures shown herein depict example arrangements of elements, additional intervening elements, devices, features, or components may be present in an actual embodiment. It should also be understood that FIGS. 1-5 are merely illustrative and may not be drawn to scale.

Figure 1:
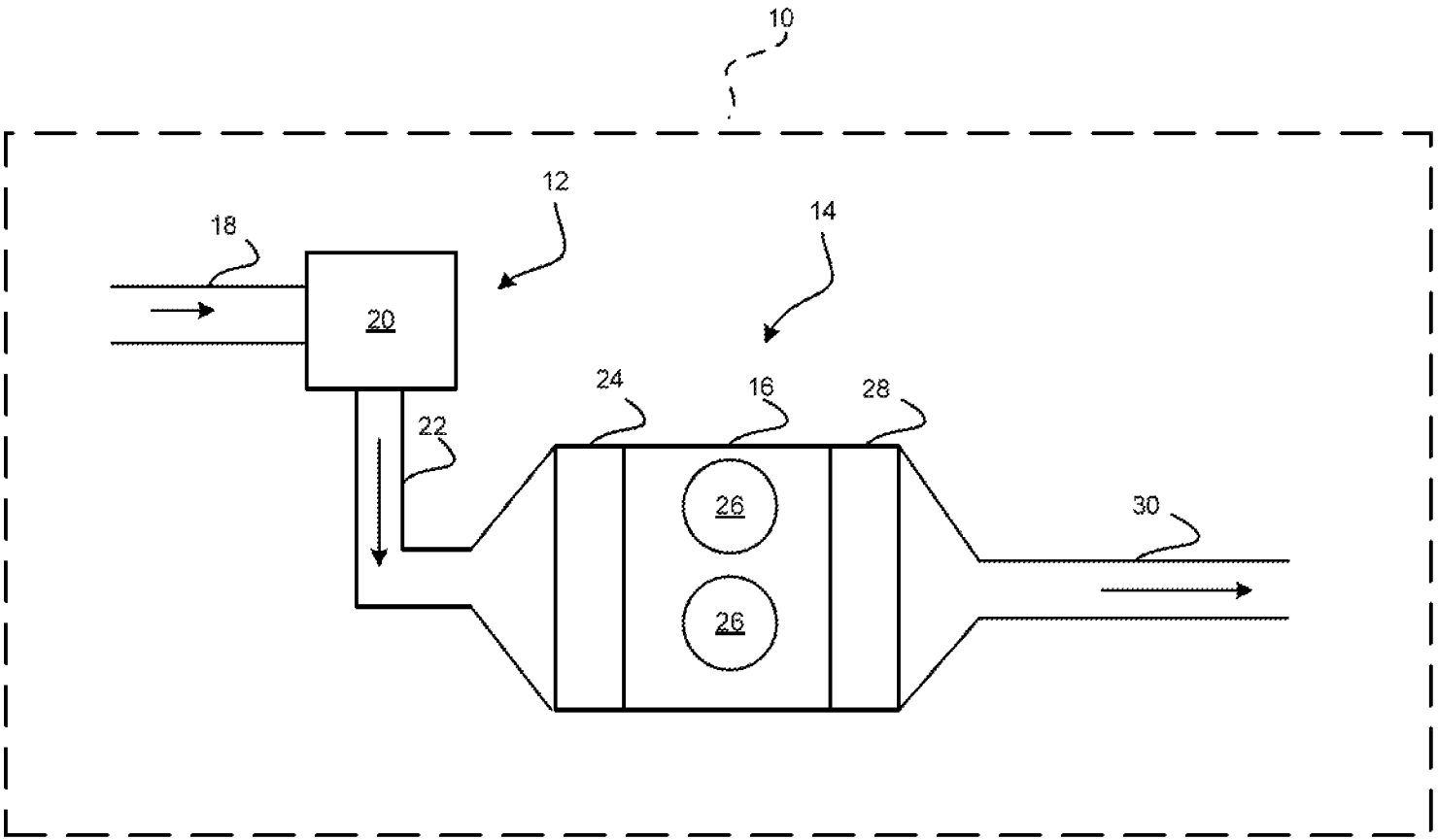
FIG. 1 is a functional block diagram illustrating a vehicle that includes an air induction system in accordance with various embodiments.

Referring now to FIG. 1, exemplary embodiments of the disclosure are directed to a vehicle 10 including an air induction system, shown generally at 12, that is associated with an engine system, shown generally at 14. As can be appreciated, the air induction system described herein can be implemented in various vehicles having various engine systems. Such vehicles may include, for example, but are not limited to, automotive vehicles, sport utility vehicles, water vehicles, etc. Such engine systems may include, for example, but are not limited to, internal combustion engines including diesel engines, gasoline direct injection systems, and homogeneous charge compression ignition engine systems, etc. While FIG. 1 depicts various electrical and mechanical connections and couplings in a very simplified manner for ease of description, an actual embodiment of the vehicle 10 will of course utilize additional physical components and devices that are known in the industry.

As shown in FIG. 1, the engine system 14 couples to the air induction system 12. The engine system 14 includes an internal combustion engine (hereinafter referred to as engine 16) that combusts an air/fuel mixture to produce drive torque. Air is drawn in to the engine 16 through the air induction system 12. In general, the air induction system 12 includes an inlet duct 18, an air cleaner 20, and an outlet duct 22. Air is drawn in to the air cleaner 20 through the inlet duct 18 and cleaned therein. As will be discussed in more detail below, the inlet duct 18 includes a tuning system in accordance with exemplary embodiments. The outlet duct 22 permits the flow of clean air from the air cleaner 20 to an intake manifold 24 of the engine 16. The clean air is drawn in to cylinders 26 of the engine 16 from the intake manifold 24 where it is mixed with fuel and combusted therein. While the engine 16 may include multiple cylinders 26 arranged in various configurations, for illustration purposes, two representative cylinders 26 are illustrated arranged in an in-line configuration. Byproducts of the combustion are exhausted from the engine 16 via an exhaust manifold 28 and treated in an exhaust system 30 before exiting the vehicle 10.

Figure 2:
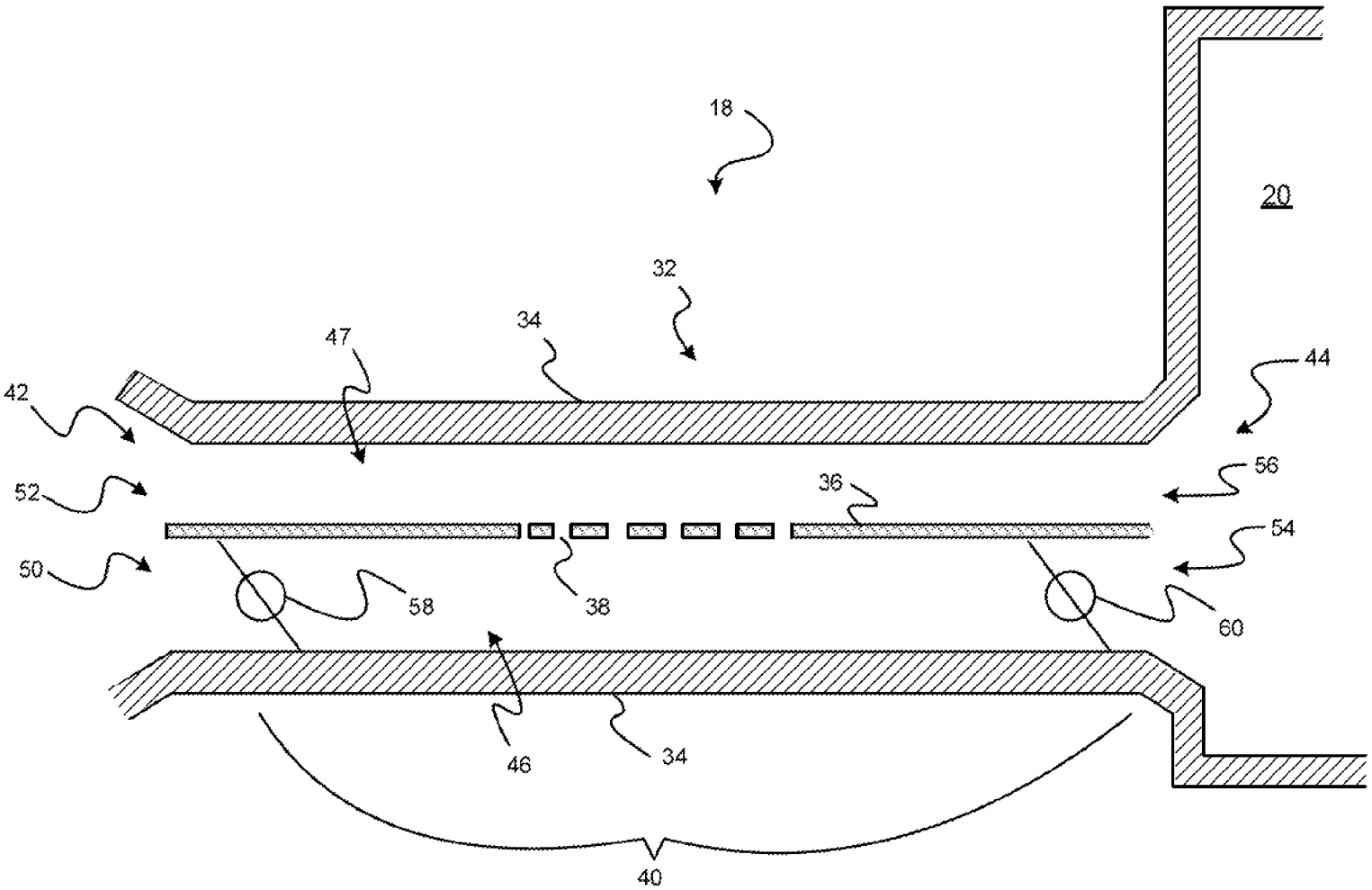
FIG. 2 is a side cross-sectional view of an air induction system in accordance with exemplary embodiments.
Figure 4:
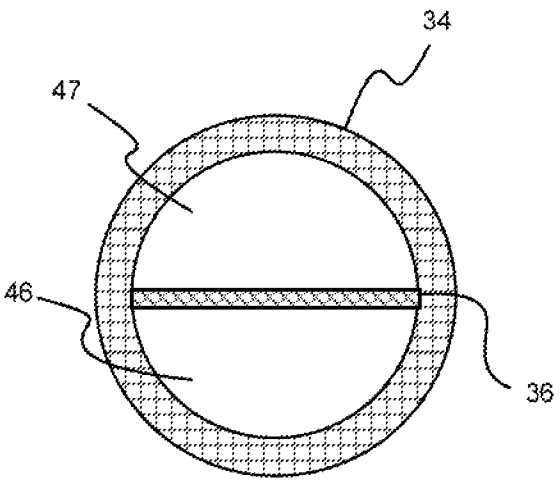
FIGS. 3 and 4 are front cross-sectional views of an inlet duct of the air induction system of FIG. 2 in accordance with exemplary embodiments.
Figure 3:
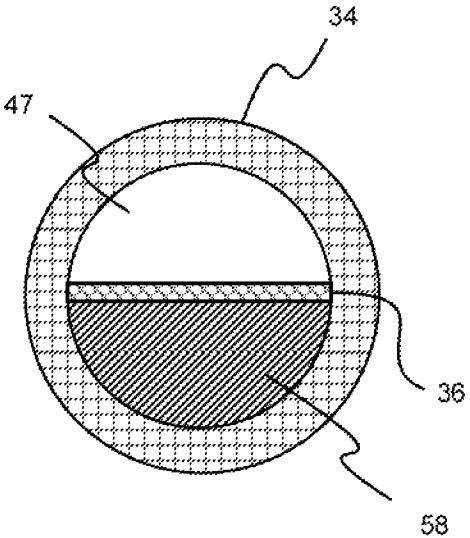
Figure 5:
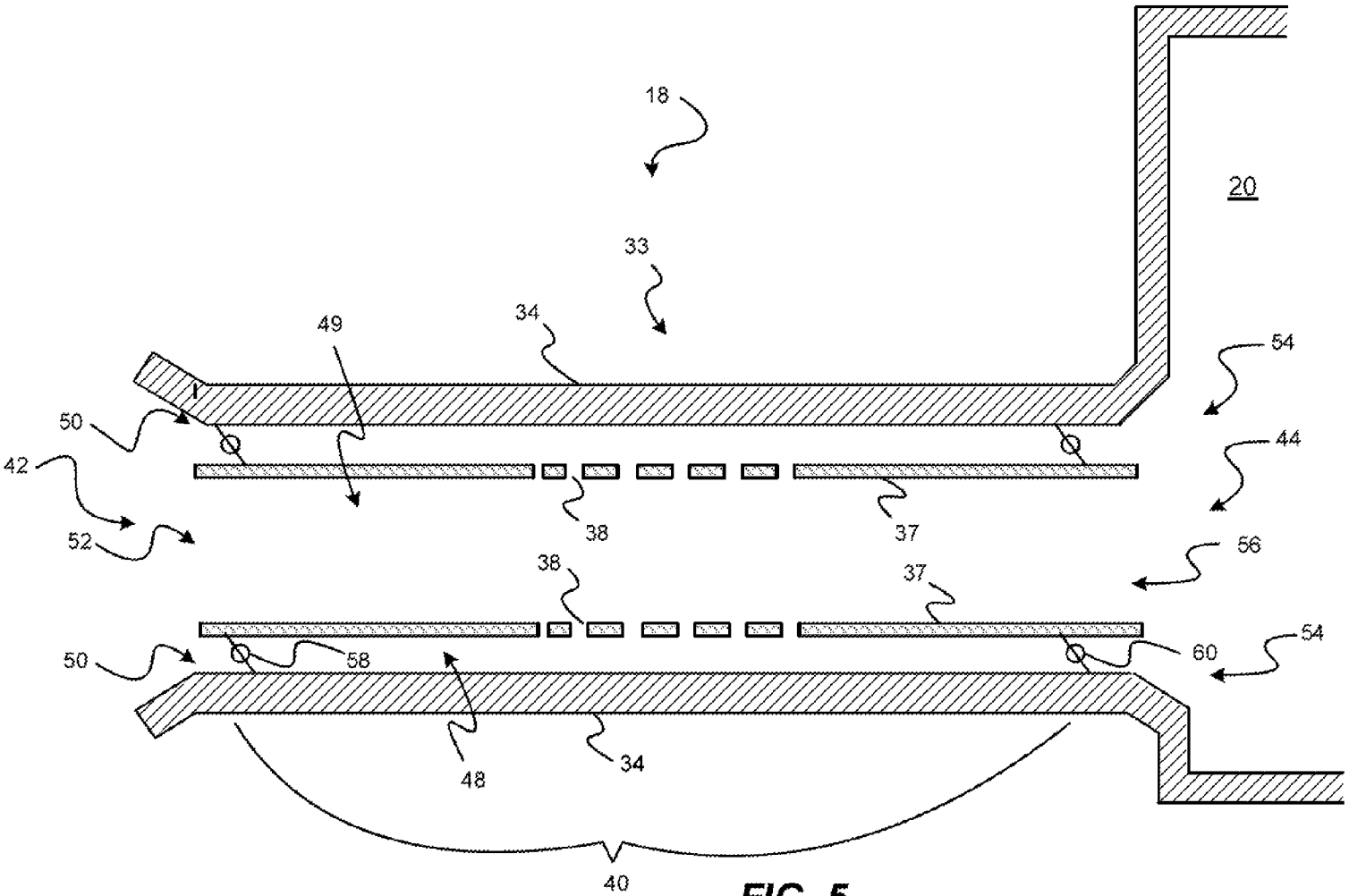
FIG. 5 is a side cross-sectional view of an air induction system in accordance with other exemplary embodiments.
Figure 7:
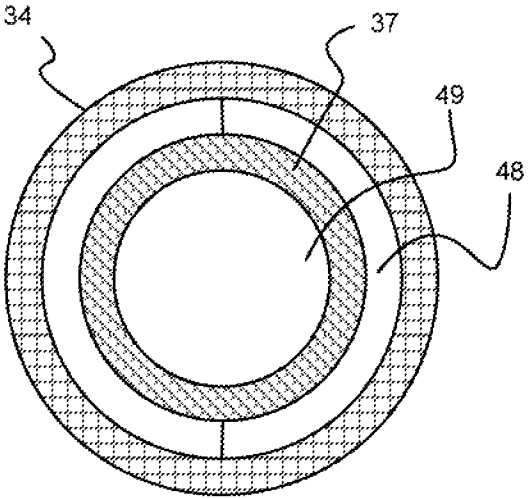
FIGS. 6 and 7 are front cross-sectional views of an inlet duct of the air induction system of FIG. 5 in accordance with exemplary embodiments.
Figure 6:
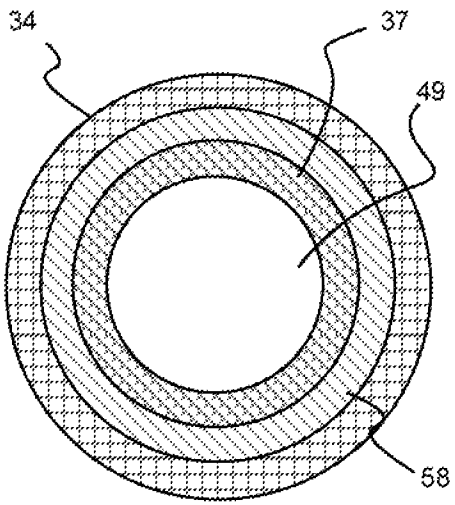

Referring now to FIGS. 2-7 where the inlet duct 18 is shown and described in more detail in accordance with various embodiments. As shown in FIGS. 2 and 5, the inlet duct 18 includes a tuning system (e.g., shown generally at 32 in FIGS. 2 and 33 in FIG. 5) in accordance with exemplary embodiments. The tuning system 32, 33 includes, for example, a tubular housing 34, an inner wall (e.g., shown as 36 in FIGS. 2 and 37 in FIG. 5) having a plurality of perforations or resonators 38 and a valve set 40. An inlet 42 of the tubular housing 34 receives air (e.g., from ambient or other air intake components (not shown)). As illustrated, the inlet 42 may be bell-shaped or any other shape to draw in the air. The air passes through the tubular housing 34 and exits to the air cleaner 20 via an outlet 44.

The inner wall 36 is disposed within the tubular housing 34 so as to create at least two flow passages. In various embodiments, as shown in FIG. 2, the inner wall 36 is a planar wall that runs parallel with the tubular housing 34, from the inlet 42 of the tubular housing 34 to the outlet 44 of the tubular housing 34. The inner planar wall divides the tubular housing 34 into a first side flow passage 46 and a second side flow passage 47.

In various other embodiments, as shown in FIG. 5, the inner wall 37 is a tubular wall that runs parallel with the tubular housing 34, from the inlet 42 of the tubular housing 34 to the outlet 44 of the tubular housing 34. The inner wall 37 divides the tubular housing 34 into a first outer side flow passage 48 and a second inner flow passage 49. As can be appreciated, the size, shape, and placement of the inner wall 36, 37 can be varied in accordance with various embodiments.

Each flow passage 46-49 includes an inlet 50, 52 that corresponds to the inlet 42 of the tubular housing 34 and an outlet 54, 56 that corresponds to the outlet 44 of the tubular housing 34. In various embodiments, the size of the flow passages 48-49 can be substantially equal, the first flow passage 46, 48 may be greater than the second flow passage 47, 49 or the second flow passage 47, 49 may be greater than the first flow passage 46, 48.

As shown in FIGS. 2 and 5, the inner wall 36, 37 includes the one or more perforations, or resonator 38. As will be discussed in more detail below, the perforations and resonators 38 allow one of the flow passages 46 or 47, 48 or 49, to function in a second mode, as a tuning cavity. For example, as air flows past the perforations or resonators 38, the perforations or resonators 38 advantageously suppress undesirable frequencies in the sound being emanated by the air induction system 12 (FIG. 1) and/or provide additional frequencies for attenuation purposes. As can be appreciated, the number, size and location of the perforations or resonators 38 may vary depending on airflow characteristics of the engine system 14. In various embodiments, the resonators 38 may be Hemholtz resonators, Quarter Wave resonators, or other resonators known in the art.

The valve set 40 is associated with at least one of the flow passages 46-49. In various embodiments, a first valve 58 of the valve set 40 is disposed substantially near the inlet 50 of the flow passage 46. A second valve 60 of the valve set 40 is disposed substantially near the outlet 54 of the flow passage 48. The valves 58, 60 can be a flap valve, a spring-loaded valve, an electronically controlled valve, and/or other type of valve.

The valve set 40 selectively controls airflow through the first flow passage 46 according to at least two modes. For example, when each valve 58, 60 of the valve set 40 is in a first position (e.g., an open position as shown in the front cross-sectional view of FIG. 4 with respect to the planar inner wall 36 and as shown in the front cross-sectional view of FIG. 7 with respect to the tubular inner wall 37) the airflow is controlled according to a first mode. The first mode is a flow-through mode that provides for air flowing substantially through the first flow passage 46, 48 by entering through the inlet 50 of the first flow passage 46, 48 and exiting through the outlet 54 of the first flow passage 46, 48. In another example, when each valve 58, 60 of the valve set 40 is in a second position (e.g., a closed position as shown in the front cross-sectional view of FIG. 3 with respect to the planar inner wall 36 and as shown in the front cross-sectional view of FIG. 6 with respect to the tubular inner wall 37) the airflow is controlled according to a second mode. The second mode is a tuning mode that provides for air flowing substantially through the second flow passage 47, 49, past the perforations or resonators 38 while the first flow passage 46, 48 functions as a tuning cavity.

It will be appreciated that the closed position of the valves 58, 60 may imply an air-tight seal, or a substantial blocking of air passage through the first flow passage 46, 48. While the embodiments have been described with regard to the valves 58, 60 being in an open and a closed position, it is appreciated that in some embodiments the valves 58, 60 may move directly between the closed and open positions, while in other embodiments, the valves 58, 60 may move in steps (e.g., 10% steps, 25% steps) between the open and closed position responsive to the air intake needs of the engine 16 (FIG. 1), thus providing variations in the flow-through mode or additional flow-through modes. Still other embodiments employ infinitely variable valves 58, 60 that may set to any point between the closed and open positions, to provide variations in the flow-through mode or additional flow-through modes. Thus, it will be appreciated that an open (that is, non-closed) position may not be limited to an unobstructed opening, but rather, a sufficient opening as required to meet the air intake needs of the engine 16 (FIG. 1).

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. An air inlet duct of an internal combustion engine, the air inlet duct comprising:

a tubular housing;

an inner wall having a plurality of perforations, wherein the inner wall is disposed within the tubular housing such that the tubular housing includes at least two flow passages; and a valve set associated with a first flow passage of the at least two flow passages, wherein the valve set selectively controls airflow through the first flow passage such that the first flow passage functions in a least one of a flow-through mode and a tuning mode.

2. The air inlet duct of claim 1 wherein the valve set comprises a first valve disposed substantially near an inlet of the first flow passage, and a second valve disposed substantially near an outlet of the first flow passage.

3. The air inlet duct of claim 1 wherein the inner wall is a planar wall that divides the tubular housing into a first side flow passage and a second side flow passage, and wherein the valve set is associated with the first side flow passage.

4. The air inlet duct of claim 1 wherein when a first valve of the valve set is in an open position, the first flow passage is configured to function in the flow-through mode.

5. The air inlet duct of claim 4 wherein when the first valve of the valve set is in a closed position, the first flow passage is configured to function in the tuning mode.

6. The air inlet duct of claim 1 wherein the inner wall is a tubular wall that, when disposed within the tubular housing, divides the tubular housing into a first outer side flow passage and a second inner flow passage.

7. The air inlet duct of claim 6 wherein when a first valve of the valve set is in an open position, the first flow passage is functioning in the flow-through mode.

8. The air inlet duct of claim 7 when the first valve of the valve set is in a closed position, the first flow passage is functioning in the tuning mode.

9. The air inlet duct of claim 1 wherein the plurality of perforations are at least one of Hemholtz resonators and Quarter Wave resonators.

10. An air induction system for an internal combustion engine, comprising:

an air cleaner; and an air inlet duct coupled to the air cleaner, the air inlet duct comprising:

a tubular housing;

an inner wall having a plurality of perforations, wherein the inner wall is disposed within the tubular housing such that the tubular housing includes at least two flow passages; and a valve set associated with a first flow passage of the at least two flow passages, wherein the valve set selectively controls airflow through the first flow passage such that the first flow passage functions in a least one of a pass-through mode and a tuning mode.

11. The air induction system of claim 10 wherein the valve set comprises a first valve disposed substantially near an inlet of the first flow passage, and a second valve disposed substantially near an outlet of the first flow passage.

12. The air induction system of claim 10 wherein the inner wall is a planar wall that divides the tubular housing into a first side flow passage and a second side flow passage, and wherein the valve set is associated with the first side flow passage.

13. The air induction system of claim 10 wherein when a first valve of the valve set is in an open position, the first flow passage is functioning in the flow-through mode.

14. The air induction system of claim 13 wherein when the first valve of the valve set is in a closed position, the first flow passage is functioning in the tuning mode.

15. The air induction system of claim 10 wherein the inner wall is a tubular wall that, when disposed within the tubular housing, divides the tubular housing into a first outer flow passage and a second inner flow passage.

16. The air induction system of claim 15 wherein when a first valve of the valve set is in an open position, the first flow passage is configured to function in the flow-through mode.

17. The air induction system of claim 16 when the first valve of the valve set is in a closed position, the first flow passage is configured to function in the tuning mode.

18. The air induction system of claim 10 wherein the plurality of perforations are at least one of Hemholtz resonators and Quarter Wave resonators.

19. A vehicle, comprising:

an engine system; and an air inlet duct coupled to the engine system, the air inlet duct comprising:

a tubular housing;

an inner wall having a plurality of perforations, wherein the inner wall is disposed within the tubular housing such that the tubular housing includes at least two flow passages; and a valve set associated with a first flow passage of the at least two flow passages, wherein the valve set selectively controls airflow through the first flow passage such that the first flow passage functions in a least one of a pass-through mode and a tuning mode.

* * * * *